US011317181B2

(12) United States Patent
Li

(10) Patent No.: US 11,317,181 B2
(45) Date of Patent: Apr. 26, 2022

(54) SPEAKER BOX AND ELECTRONIC DEVICE

(71) Applicant: AAC Technologies Pte. Ltd., Singapore (SG)

(72) Inventor: Jinming Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/995,781

(22) Filed: Aug. 17, 2020

(65) Prior Publication Data

US 2020/0413175 A1 Dec. 31, 2020

Related U.S. Application Data

(63) Continuation of application No. PCT/CN2019/093200, filed on Jun. 27, 2019.

(51) Int. Cl.
*H04R 1/02* (2006.01)

(52) U.S. Cl.
CPC ..... *H04R 1/025* (2013.01); *H04R 2201/02* (2013.01); *H04R 2201/029* (2013.01); *H04R 2400/11* (2013.01)

(58) Field of Classification Search
None
See application file for complete search history.

(56) References Cited

U.S. PATENT DOCUMENTS

2013/0259284 A1* 10/2013 Shi ..... H04R 1/025 381/335
2020/0004364 A1* 1/2020 Jung ..... G06F 3/0412
2021/0067852 A1* 3/2021 Li ..... H04R 1/02

* cited by examiner

*Primary Examiner* — Walter F Briney, III
(74) *Attorney, Agent, or Firm* — W&G Law Group

(57) ABSTRACT

The present invention provides a speaker box and an electronic device. The speaker box includes: a case having a receiving space; a speaker body having a sound outlet and received in the receiving space; and a graphite sheet received in the receiving space and connected to both the speaker body and the case. The speaker body divides the receiving space into a front cavity in communication with the sound outlet and a rear cavity opposite to the front cavity. The electronic device uses the speaker box. Compared with the related art, the speaker box and the electronic device provided by the present invention have a better heat dissipation effect.

7 Claims, 7 Drawing Sheets

III–III

SPEAKER BOX AND ELECTRONIC DEVICE

TECHNICAL FIELD

The present invention relates to the field of acoustoelectric conversion, and more particularly, to a speaker box and an electronic device.

BACKGROUND

With the rapid development of science and technology, an audio device has been used in more and more applications. Among a variety of entertainment manners, high-quality music enjoyment is gradually popularized. Therefore, a speaker box for playing an audio file has been widely used in the current electronic devices.

The speaker box in the related art includes: an upper cover; a lower cover, the lower cover and the upper cover together defining a receiving space; a speaker body received in the receiving space; and a vibration-resistant foam sandwiched between the speaker body and the lower cover. The lower cover includes a body portion and a steel sheet embedded into the body portion. The vibration-resistant foam is sandwiched between the steel sheet and the speaker body.

However, the vibration-resistant foam and the steel sheet in the related art have poor thermal conductivity, and the thermal conductivity of the steel sheet is only 17 w/M·K. Therefore, heat in the speaker box cannot be quickly transferred to the outside, resulting in poor heat dissipation.

Therefore, it is necessary to provide an improved speaker box and an improved electronic device to solve the problems described above.

SUMMARY

In view of the problems in the related art that the vibration-resistant foam and the steel sheet in the speaker box in the related art have poor thermal conductivity, so heat in the speaker box cannot be quickly transferred to the outside, resulting in poor heat dissipation, the present invention provides a speaker box having a better heat dissipation effect.

An embodiment of the present invention provides a speaker box, including: a case having a receiving space; a speaker body having a sound outlet and received in the receiving space; and a graphite sheet received in the receiving space and connected to both the speaker body and the case. The speaker body divides the receiving space into a front cavity in communication with the sound outlet and a rear cavity opposite to the front cavity.

As an improvement, the case includes an upper cover and a lower cover, and the upper cover and the lower cover together defines the receiving space, wherein the lower cover includes a body portion, a through hole penetrating through the body portion and in communication with the receiving space, and a copper alloy sheet completely covering the through hole and fixed to the body portion.

As an improvement, the graphite sheet is connected to both the speaker body and the copper alloy sheet; the speaker body, the body portion, the copper alloy sheet, and the upper cover together define the rear cavity; the speaker body includes a front end, at which the sound outlet is provided, and a rear end opposite to the front end; and the through hole directly faces the rear end.

As an improvement, the copper alloy sheet includes a body part completely covering the through hole, and at least one fixing wall extending from a periphery of the body part towards the upper cover while being bent, wherein the at least one fixing wall is embedded into the body part.

As an improvement, the graphite sheet includes a first surface and a second surface that are opposite to each other, the first surface is adhesively fixed to the rear end, and the second surface is adhesively fixed to the body part.

As an improvement, the at least one fixing wall includes at least one first fixing wall, and at least one second fixing wall spaced from the at least one first fixing wall, wherein each of the at least one second fixing wall includes a first portion extending from the periphery of the body part towards the upper cover while being bent, and a second portion extending from an end of the first portion close to the upper cover in a direction facing away from the body part.

As an improvement, the body part has a rectangular shape, the at least one first fixing wall includes a plurality of first fixing walls arranged at four sides of the body part, and the at least one second fixing wall includes two second fixing walls arranged at one side of the body part.

As an improvement, the second portion is parallel to the body part.

As an improvement, the copper alloy sheet and the body portion are formed into one piece by injection molding.

An embodiment of the present invention provides an electronic device, including: a housing having an accommodating space; and the speaker box as described above and fixed into the accommodating space.

Compared with the related art, in the speaker box provided by the present invention, the speaker body is connected to the case through the graphite sheet, so that the heat inside the speaker box can be quickly transferred to the outside due to the extremely high thermal conductivity of the graphite sheet, thereby improving the heat dissipation effect of the speaker box.

Correspondingly, since the electronic device provided by the present invention adopts the speaker box having a good heat dissipation effect and thus a good acoustic performance, the electronic device has a good acoustic performance.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The technical solutions in the embodiments of the present invention are described below with reference to the accompanying drawings. It should be understood that the described embodiments are merely exemplary embodiments of the present invention, which shall not be interpreted as providing limitations to the present invention. All other embodiments obtained by those skilled in the art without creative efforts according to the embodiments of the present invention are within the protection scope of the present invention.

Figure 1:
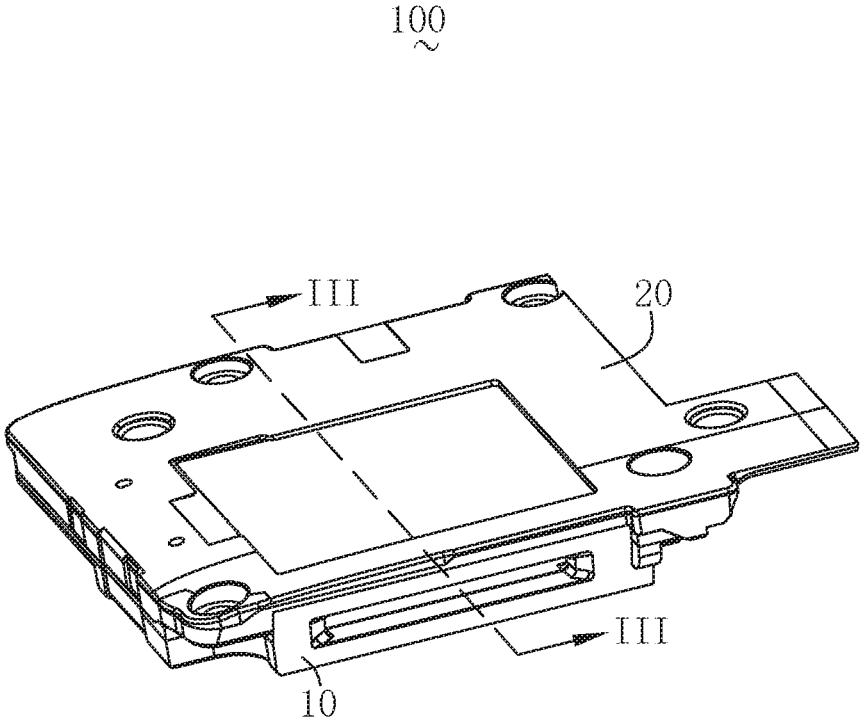
FIG. 1 is a schematic perspective view of a speaker box according to the present invention.
Figure 2:
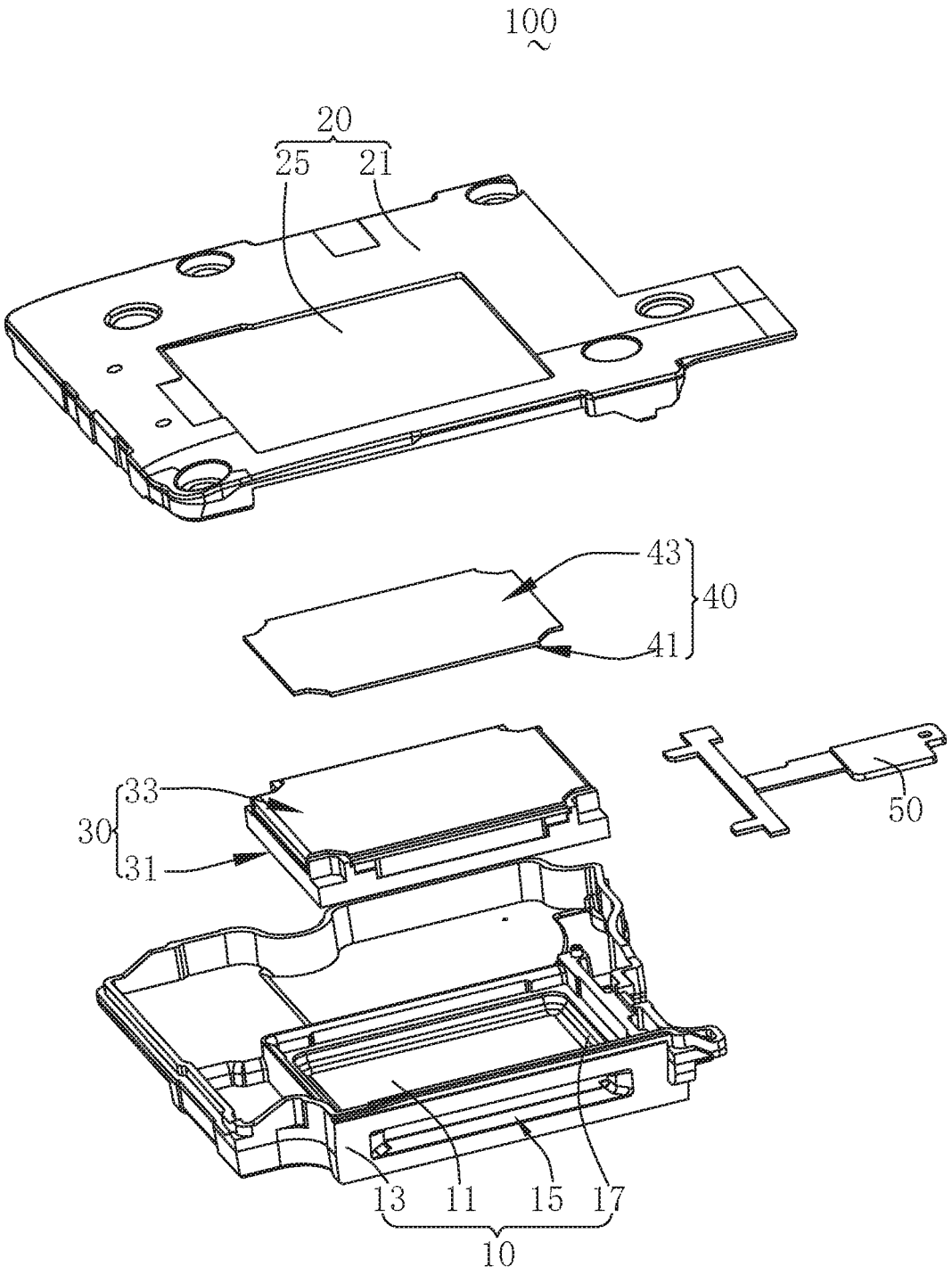
FIG. 2 is a schematic exploded view of the speaker box shown in FIG. 1.
Figure 3:
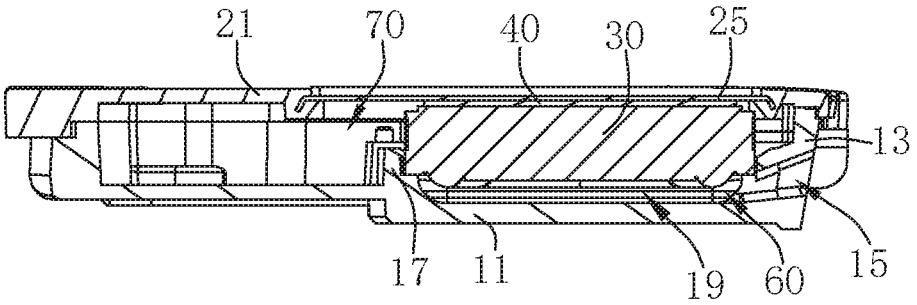
FIG. 3 is a cross-sectional view along line of FIG. 1.

With reference to FIG. 1 to FIG. 3, the present invention provides a speaker box 100, including: a case having a receiving space, a speaker body 30 received in the receiving space, a graphite sheet 40 received in the receiving space and sandwiched between the case and the speaker body 30; and a flexible circuit board 50 connected to the speaker body 30 and extending out of the receiving space. The case includes an upper cover 10 and a lower cover 20, and the upper cover 10 and the lower cover 20 together define the receiving space. The graphite sheet 40 is sandwiched between the speaker body 30 and the lower cover 20. The speaker body 30 divides the receiving space into a front cavity 60 in communication with a sound outlet and a rear cavity 70 opposite to the front cavity 60. The front cavity 60 is configured to generate sound, and the rear cavity 70 is configured to improve a low-frequency acoustic performance.

The upper cover 10 includes a top wall 11, a side wall 13 extending from a periphery of the top wall 11 towards the lower cover 20 while be bent, a sound guide channel 15 formed in the side wall 13, and a support wall 17 extending from the top wall 11 towards the lower cover 20. The speaker body 30 is mounted to the support wall 17 and is spaced apart from the top wall 11 to form a front sound cavity 19. The sound guide channel 15 communicates with the front sound cavity 19 to form the front cavity 60, thereby forming a side sounding structure.

Figure 4:
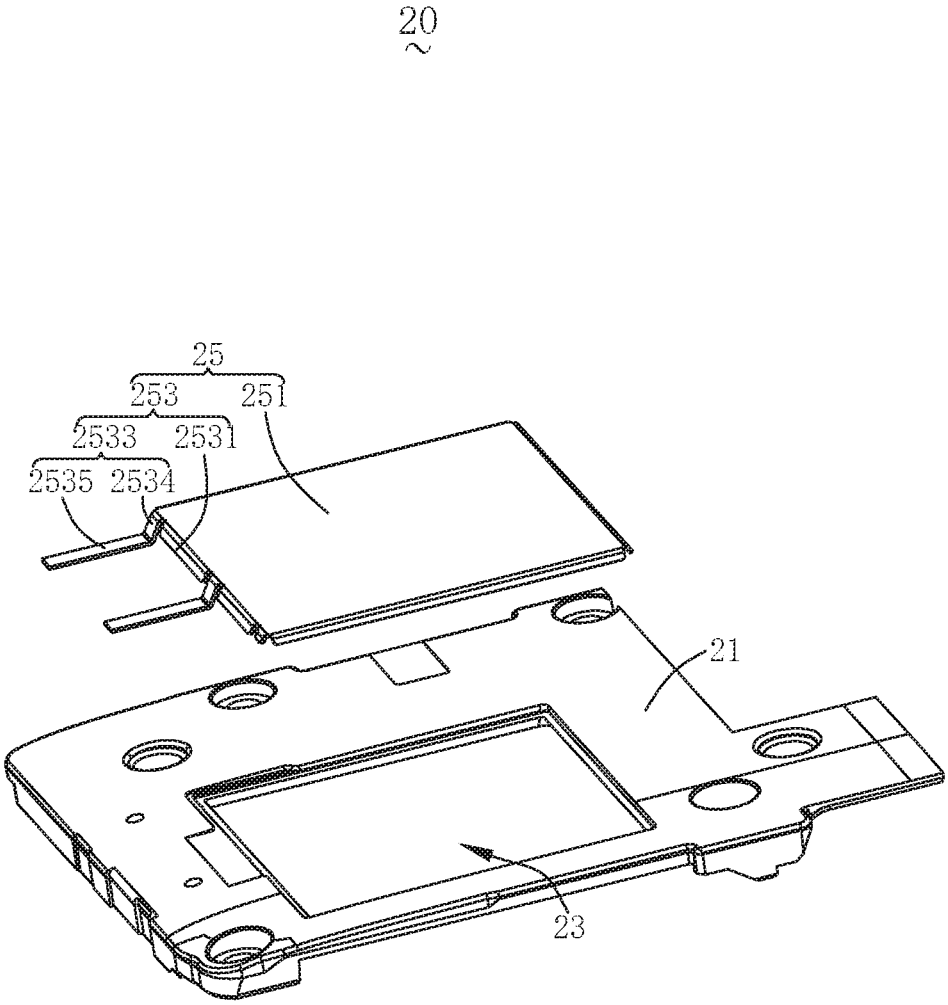
FIG. 4 is a schematic exploded view of a lower cover shown in FIG. 2.
Figure 5:
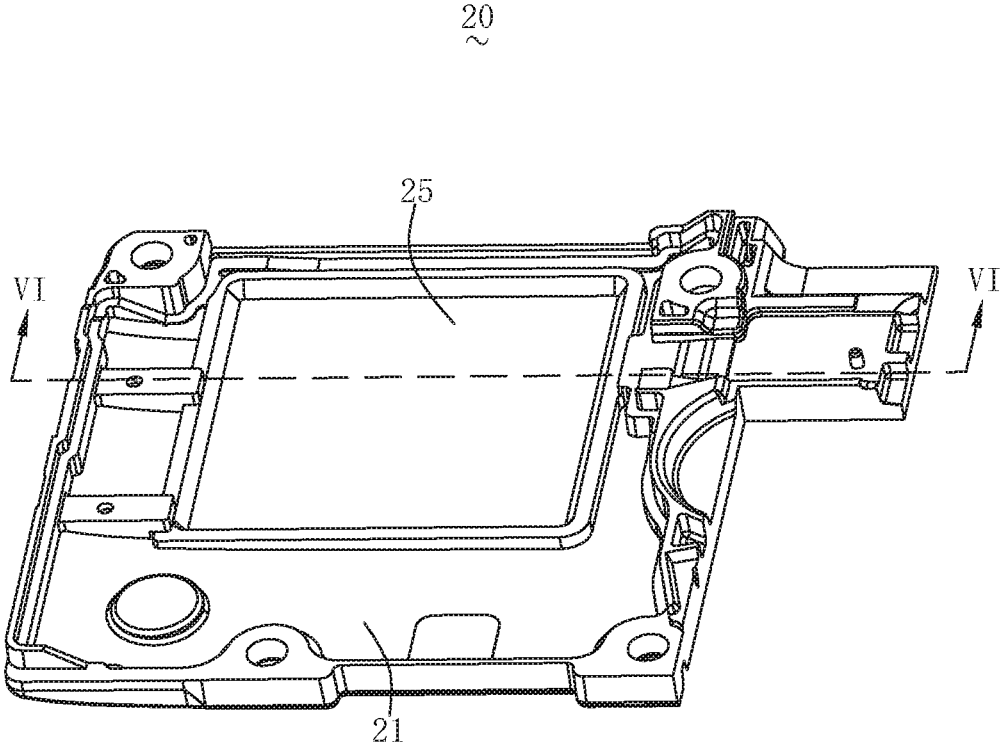
FIG. 5 is a schematic perspective view of the lower cover shown in FIG. 2 at another viewing angle.
Figure 6:
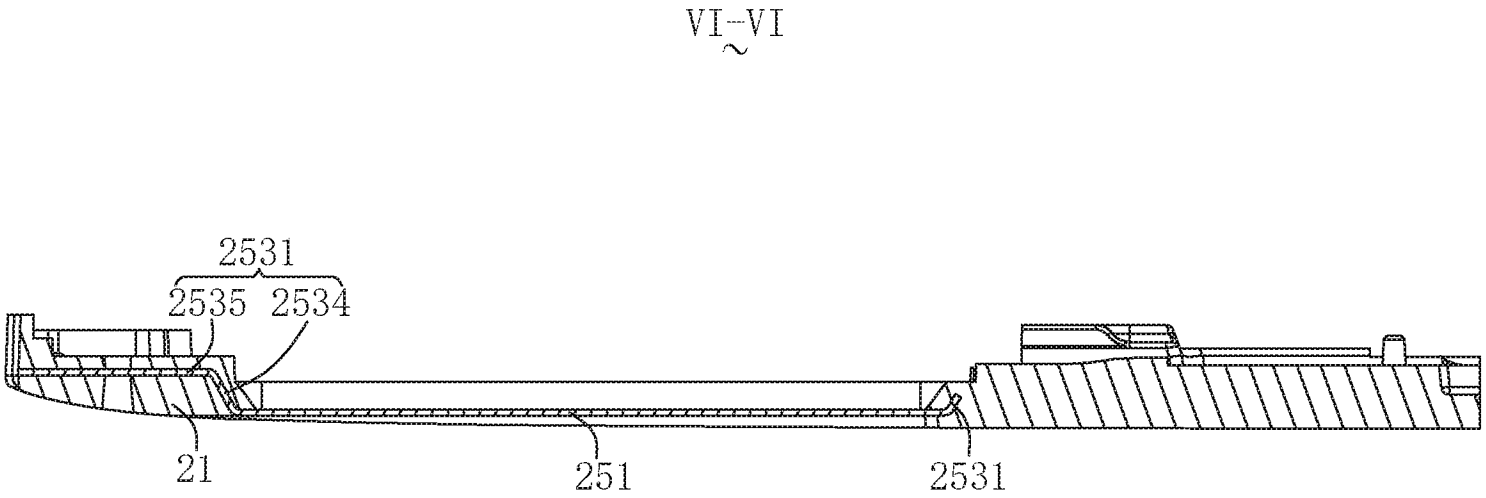
FIG. 6 is a cross-sectional view along line VI-VI of FIG. 5.

With reference to FIG. 4 to FIG. 6, the lower cover 20 includes a body portion 21, a through hole 23 penetrating through the body portion 21 and in communication with the receiving space, and a copper alloy sheet 25 completely covering the through hole 23 and fixed to the body portion 21. The through hole 23 directly faces the speaker body 30.

In this embodiment, the speaker body 30, the body portion 21, the copper alloy sheet 25, and the upper cover 10 together define the rear cavity 70. It should be noted that in other embodiments, the copper alloy sheet 25 may be disposed around the front cavity 60.

The copper alloy sheet 25 and the body portion 21 are formed into one piece by injection molding, so that a fixing effect between the copper alloy sheet 25 and the body portion 21 is better, and connection stability thereof is also improved. The copper alloy sheet 25 includes a body part 251 completely covering the through hole 23, and at least one fixing wall 253 extending from a periphery of the body part 251 towards the upper cover 10 while being bent. The at least one fixing wall 253 is embedded into the body portion 21 in such a manner that the connection between the copper alloy sheet 25 and the body portion 21 is more stable, and detachment is less likely to occur.

The body part 251 has a rectangular and flat plate-like shape, and the at least one fixing wall 253 includes a first fixing wall 2531 and a second fixing wall 2533 spaced apart from the first fixing wall 2531. In an embodiment, a plurality of first fixing walls 2531 are provided and disposed at four sides of the body part 251; and two second fixing walls 2533 are provided and disposed at one side of the body part 251.

The second fixing wall 2533 includes a first portion 2534 extending from the periphery of the body part 251 towards the upper cover 10 while being bent, and a second portion 2535 extending from an end of the first portion 2534 close to the upper cover 10 in a direction facing away from the body part 251. The second portion 2535 is parallel to the body part 251. Each of the first portion 2534 and the second portion 2535 has an elongated flat plate-like shape, and a length of the second portion 2535 is larger than a length of the first portion 2534. With the first portion 2534 and the second portion 2535, a connection area between the fixing wall 253 and the body part 251 is larger, and thus an effect of fixing the copper alloy sheet 25 by the body part 251 can be effectively improved.

With further reference to FIG. 2, the speaker body 30 includes a front end 31 at which the sound outlet is provided and a rear end 33 opposite to the front end 31. The through hole 23 directly faces the rear end 33. In this way, the copper alloy sheet 25 can better and more effectively transfer heat generated by the speaker body 30 to the outside, thereby increasing a heat dissipation effect of the speaker box 100.

The graphite sheet 40 is received in the receiving space and connected to both the speaker body 30 and the copper alloy sheet 25. For example, the graphite sheet 40 has a flat plate-like shape, and includes a first surface 41 and a second surface 43 that face towards each other. The first surface 41 is adhesively bonded and fixed to the rear end 33, and the second surface 43 is adhesively bonded and fixed to the body part 251.

The copper alloy sheet 25 has a thermal conductivity of 165 w/M·K, and the graphite sheet 40 has a thermal conductivity of 1600 w/M·K. It can be understood that, the heat inside the speaker box 100 can be quickly transferred to the outside due to the extremely high thermal conductivities of the copper alloy sheet 25 and the graphite sheet 40, achieving an excellent heat dissipation effect.

Figure 7:
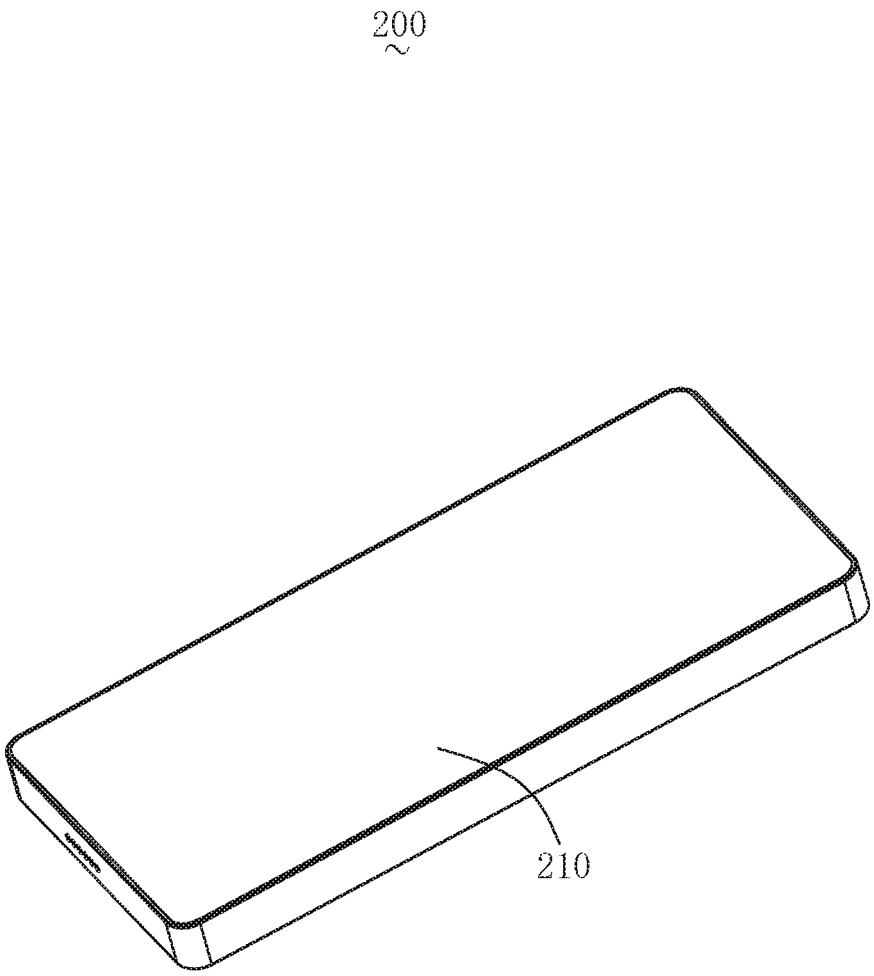
FIG. 7 is a schematic perspective view of an electronic device according to the present invention.

With reference to FIG. 7, the present invention further provides an electronic device 200, including a housing 210 having an accommodating space and the speaker box 100 fixed in the accommodating space.

Compared with the related art, in the speaker box provided by the present invention, the speaker body is connected to the case through the graphite sheet, and thus the heat inside the speaker box can be quickly transferred to the outside due to the of the graphite sheet, thereby improving the heat dissipation effect of the speaker box.

Correspondingly, since the electronic device provided by the present invention uses the speaker box having a good heat dissipation effect and thus a good acoustic performance, the electronic device has a good acoustic performance.

The above description merely illustrates some embodiments of the present invention. It should be noted that those skilled in the art may make improvements without departing from a creative concept of the present invention, and all these improvements shall fall into a protection scope of the present invention.

What is claimed is:

1. A speaker box, comprising:

a case having a receiving space;

a speaker body having a sound outlet and received in the receiving space; and a graphite sheet received in the receiving space and connected to both the speaker body and the case, wherein the speaker body divides the receiving space into a front cavity in communication with the sound outlet and a rear cavity opposite to the front cavity, the case comprises an upper cover and a lower cover, and the upper cover and the lower cover together defines the receiving space, wherein the lower cover comprises a body portion, a through hole penetrating through the body portion and in communication with the receiving space, and a copper alloy sheet completely covering the through hole and fixed to the body portion, the graphite sheet is connected to both the speaker body and the copper alloy sheet, the speaker body, the body portion, the copper alloy sheet, and the upper cover together define the rear cavity; the speaker body comprises a front end, at which the sound outlet is provided, and a rear end opposite to the front end; and the through hole directly faces the rear end, the copper alloy sheet comprises a body part completely covering the through hole, the graphite sheet comprises a first surface and a second surface that are opposite to each other, the first surface is adhesively fixed to the rear end, and the second surface is adhesively fixed to the body part.

2. The speaker box as described in claim 1, wherein the copper alloy sheet comprises at least one fixing wall extending from a periphery of the body part towards the upper cover while being bent, wherein the at least one fixing wall is embedded into the body part.

3. The speaker box as described in claim 2, wherein the at least one fixing wall comprises at least one first fixing wall, and at least one second fixing wall spaced from the at least one first fixing wall, wherein each of the at least one second fixing wall comprises a first portion extending from the periphery of the body part towards the upper cover while being bent, and a second portion extending from an end of the first portion close to the upper cover in a direction facing away from the body part.

4. The speaker box as described in claim 3, wherein the body part has a rectangular shape, the at least one first fixing wall comprises a plurality of first fixing walls arranged at four sides of the body part, and the at least one second fixing wall comprises two second fixing walls arranged at one side of the body part.

5. The speaker box as described in claim 3, wherein the second portion is parallel to the body part.

6. The speaker box as described in claim 1, wherein the copper alloy sheet and the body portion are formed into one piece by injection molding.

7. An electronic device, comprising:

a housing having an accommodating space; and the speaker box as described in claim 1 and fixed into the accommodating space.

* * * * *